US009988747B2

(12) United States Patent
Lonati et al.

(10) Patent No.: US 9,988,747 B2
(45) Date of Patent: Jun. 5, 2018

(54) THREAD ASPIRATING DEVICE FOR A DIAL GROUP OF A CIRCULAR KNITTING MACHINE

(71) Applicant: Santoni S.P.A., Brescia (IT)

(72) Inventors: Tiberio Lonati, Brescia (IT); Ettore Lonati, Botticino (IT); Fausto Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 115 days.

(21) Appl. No.: 15/032,377

(22) PCT Filed: Nov. 5, 2014

(86) PCT No.: PCT/IB2014/065827
§ 371 (c)(1),
(2) Date: Apr. 27, 2016

(87) PCT Pub. No.: WO2015/068117
PCT Pub. Date: May 14, 2015

(65) Prior Publication Data

US 2016/0251784 A1 Sep. 1, 2016

(30) Foreign Application Priority Data

Nov. 11, 2013 (IT) ..... BS2013A0162

(51) Int. Cl.
*D04B 15/61* (2006.01)

(52) U.S. Cl.
CPC ..... *D04B 15/61* (2013.01)

(58) Field of Classification Search
CPC ..... D04B 15/61; D04B 15/58; D04B 15/60
(Continued)

(56) References Cited

U.S. PATENT DOCUMENTS 3,257,829 A * 6/1966 Parthum ..... D04B 15/60 66/134
3,668,899 A * 6/1972 Grewcock ..... D04B 15/61 66/140 S (Continued)

FOREIGN PATENT DOCUMENTS

DE 1585361 A1 1/1970
GB 1197365 A 7/1970
WO 2011042299 A1 4/2011

*Primary Examiner* — Danny Worrell
(74) *Attorney, Agent, or Firm* — Pearne & Gordon LLP

(57) ABSTRACT

A thread aspirating device (1) for circular knitting machines, comprising a body (2) of the thread aspirating device having a lower side (3), defining an inlet opening (4) enabling inlet of one or more threads in the thread aspirating device, and an up per side (5), provided with an engaging portion (6) delimiting a passage opening (7) in the upper side. The thread aspirating device comprises a mouthpiece (10) extending between an open lower end (11), defining a mounting portion (12) complementarily shaped to the engaging portion, and an upper end (13) provided with an aspirating opening (14). The mouthpiece is superiorly mounted on the body of the device so that the mounting portion corresponds to the engaging portion; the mouthpiece and the body internally define an aspirating space (20) of the threads between the inlet opening and the aspirating opening. The mouthpiece and the body overall form, in mounting condition, a thread aspirating device in a single body.

18 Claims, 7 Drawing Sheets

(58) Field of Classification Search
USPC ..... 66/168, 149 S, 145 S, 140 S
See application file for complete search history.

(56) References Cited

U.S. PATENT DOCUMENTS

| | | | | |
|---|---|---|---|---|
| 3,714,799 | A * | 2/1973 | Minton | D04B 15/61 66/140 S |
| 3,760,608 | A * | 9/1973 | Lonati | D04B 15/61 66/140 S |
| 3,881,327 | A * | 5/1975 | Mahler | D04B 15/61 66/134 |
| 3,949,571 | A | 4/1976 | Hinkle et al. | |
| 6,209,361 | B1 * | 4/2001 | Adams | D04B 15/38 66/145 S |

* cited by examiner

THREAD ASPIRATING DEVICE FOR A DIAL GROUP OF A CIRCULAR KNITTING MACHINE

The present invention relates to a thread aspirating device for a dial group of a circular knitting machine, a set of thread aspirating devices for knitting machines and a method for realizing the thread aspirating devices for circular knitting machines. The present invention further relates to a thread-aspirating device for circular knitting machines provided with a specific element for separating threads internally of the aspirating device.

The present invention relates to the technical sector of circular knitting machines for knitwear, seamless fabric, hosiery and the like.

In the present description, the term "knitting machine" is meant in general to relate to a circular knitting machine for production of textile articles and provided with a plurality of thread feeding points, in which the thread is supplied to the needles of the machine. The knitting machine can be for example of a single-bed or a double-bed type. Circular knitting machines can comprise a variable number of thread feeders, for example 2, 4, 6, 8 or more.

In the present description the expression "dial group" is intended to mean a portion of the knitting machine arranged superiorly of the needle-bearing organ and provided with organs and devices able to cooperate with the needles of the knitting machine and with the threads present in the thread feeders so as to enable production of fabric.

In the sector of circular knitting machines, the dial group is typically provided with a fixed support ring, mounted to the bearing structure of the knitting machine, a transport and cutting organ of the threads (known in the sector as a cutter) mounted externally of the support ring so as to be able to rotate about it, and a plurality of pneumatic devices positioned on the support ring.

The plurality of pneumatic devices usually comprises at least a hook control group provided with one or more command cams, able to interact with the hooks of the knitting machine, and a plurality of pneumatic actuators actuating the command cams.

In addition, the plurality of pneumatic devices can comprise clamps groups, typically equal in number to the thread feeders of the machine; each clamps group comprises one or more mobile clamps, able to retain or block a thread supplied to the needles of the knitting machine, and pneumatic actuators which move the clamps.

The dial group can further comprise cutting devices, or thread cutters, each provided with a pneumatically-activated cutting organ able to cooperate with the cutter so as to carry out the cut of the threads transported by the cutter.

In addition, the dial group can comprise thread-aspirating devices which aspirate the threads of one or more feeders and the relative fluff.

The thread aspirating devices of known type typically have a hollow tubular conformation and extend from a lower opening to an upper opening. The upper opening is connected to an aspirating tube, so that an aspiration is generated at the lower opening, while the lower part of the thread aspirating device, at which the lower opening is defined, is mounted on the support plate of the dial group of the knitting machine. Additionally the thread aspirating devices are positioned, in the dial group, in such a way that the inlet opening is superiorly neared to the thread guide group of the knitting machines, which selectively supply the threads to the cylinder needles with the aim of realizing a fabric having determined characteristics.

During the knitting work, numerous threads for each cylinder rotation are excluded from the knitting operation or held back (i.e. not associated to a needle) and thereafter returned to the knit (i.e. associated to a needle). When a thread is excluded from the knit, it can be cut: this produces a free portion of thread beyond the thread guides. To prevent this portion from snagging in components of the knitting machine, so as to ensure that it can be cut at the base before the thread is re-inserted in the knit, thread aspirating devices are known, which suck and maintain internally thereof—by means of an air aspiration—the free portions of the threads. The aspirating of the threads is done from the above-mentioned lower opening. At the point of cutting the free portion, performed with the aim of predisposing the thread at point of return to the knitting process, this portion (no longer useful) is completely sucked by the thread aspirating device and, via the aspirating opening, expelled from the knitting head.

The Applicant has found that the known-type thread aspirating devices are not free of drawbacks and can be improved in various ways, in particular with reference to the structure thereof and the effectiveness thereof in treating the aspirated threads.

A typical drawback of the known solutions is represented by the structural complexity and/or by the difficulty of use of the aspirating devices in different circular knitting machines.

A further drawback of the known thread aspirating devices is represented by the high cost thereof, in particular for supplying respective sets of thread aspirating devices to different knitting machines, which sets are each suitable for the dimensional characteristics of the respective knitting machine.

A further drawback of the thread aspirating devices is represented by the lower resistance to wear and/or the difficulty in the maintenance operations.

A further drawback of the known thread aspirating devices is represented by the tendency of threads, aspirated and contained internally of the devices, to knot together, tangle and enter into contact with one another; this can lead to malfunctioning in the knitting operations and errors in the fabric produced.

In this situation the aim at the base of the present invention, in its various aspects and/or embodiments, is to disclose a thread aspirating device for circular knitting machines which can obviate one or more of the cited drawbacks.

A further aim of the present invention is to provide a thread aspirating device which is characterised by an innovative and rational structure.

A further aim of the present invention is to provide a thread aspirating device that is easily adaptable to different circular knitting machines.

A further aim of the present invention is to provide a thread aspirating device able to aspirate and maintain internally thereof, in an efficient way, a plurality of supply threads.

A further aim of the invention is to provide a thread aspirating device able to maintain internally thereof the aspirated threads, preventing or limiting knotting, tangling and/or contacts between them.

A further aim of the present invention is to provide a thread aspirating device characterised by a high reliability of functioning and/or by a smaller predisposition to faults and malfunctioning.

A further aim of the present invention is to provide a thread aspirating device that is simple and/or rapid to realise and assemble.

A further aim of the present invention is to provide a thread aspirating device able to improve the knitting performance of a circular knitting machine.

A further aim of the present invention is to provide a thread aspirating device characterised by a manufacturing cost that with respect to its performance and the quality provided is modest.

These aims, and others besides, which will more fully emerge during the course of the following description, are substantially attained by a thread aspirating device and/or a set of thread aspirating devices and/or by a method for realising the thread aspirating devices for circular knitting machines, according to one or more of the appended claims, each of which can be taken alone (without the relative dependencies) or in any combination with the other claims, as well as according to the various aspects and/or embodiments, variously combined, and with the claims.

In a first aspect, the invention relates to a thread aspirating device for circular knitting machines, comprising:

a body of the thread aspirating device having a lower side, destined to be mounted to a support plate of a dial group of a circular knitting machine and defining, in a mounted condition to the support plate, at least an inlet opening configured for enabling inlet of one or more threads in the thread aspirating device, and an upper side, provided with an engaging portion delimiting a passage opening in the upper side;

a mouthpiece, distinct from the body of the thread aspirating device, having a substantially tubular conformation and extending between an open lower end, defining a mounting portion complementarily shaped to the engaging portion of the body of the device, and an upper end provided with an aspirating opening destined to be connected to an air aspirating device for generating a depression internally of the thread aspirating device and realize an aspiration of one or more threads into the thread aspirating device via the inlet opening.

In an aspect the mouthpiece is superiorly mounted on the body of the device in such a way that the mounting portion of the mouthpiece corresponds to the engaging portion of the body of the thread aspirating device and the mouthpiece and the body of the thread aspirating device internally define an aspirating space of the threads extending between the inlet opening and the aspirating opening.

In an aspect the mouthpiece and the body of the thread aspirating device overall form, in reciprocal mounting condition, a thread aspirating device in a single body configured for aspirating internally thereof, and maintaining in the aspirating space, one or more threads in supply to the knitting machine.

In an aspect the thread aspirating device is positioned in a dial group of a knitting machine and is configured for sucking in one or more threads and relative fluff.

In an aspect the aspirating opening is connected to an air aspirating device via an aspirating tube.

In an aspect the inlet opening is defined along a lateral edge of the body of the device, the lateral edge being destined to be positioned, with the device in the mounted configuration to the support plate of a dial group, at a portion of a perimeter edge of the support plate and superiorly thereof, in such a way as to be superiorly aligned with a thread transport and cutting organ, or "cutter" of the threads rotatably mounted externally of the support plate.

In an aspect the lateral edge of the body of the thread aspirating device has an arched conformation characterised by a determined radius of curvature and a determined lateral extension, which define a device measure, the device measure being directly correlated to the diameter of the needle cylinder of the knitting machine to which the thread aspirating device is destined.

In an aspect the determined radius of curvature of the lateral edge of the body of the thread aspirating device is substantially equal to, or proportional to, half the diameter of the needle cylinder of the knitting machine to which the thread aspirating device is destined.

In an aspect the determined lateral extension of the lateral edge of the thread aspirating device is substantially equal to the distance between two adjacent thread feeders, or thread feeding points, to the knitting machine.

In an aspect, the above-mentioned device measure increases with an increase of the diameter of the needle cylinder of the knitting machine on which the body of the aspirating device is destined to be mounted, in particular they increase the radius of curvature and the lateral extension of the lateral edge.

In an aspect the above-mentioned mouthpiece is structurally dimensioned and conformed in a single way, in particular as regards the shape and dimensions of the mounting portion, regardless of the diameter of the needle cylinder of the knitting machine to which the thread aspirating device is destined, while the body of the thread aspirating device, to which the mouthpiece can be mounted, is selected from a plurality of possible thread aspirating bodies, which have in common a shape and dimensions of the engaging portion, complementarily shaped to the mounting portion, and different as far as the respective thread aspirating device measure is concerned, the device measure being selectable without modifying the structure and/or dimensions of the mouthpiece.

In an aspect the inlet opening is configured for determining infeeding of the one or more threads of the thread aspirating device by effect of the aspiration, wherein the threads are inferiorly, at a respective dispensing point, constrained to a device for feeding thread to the needles of the knitting machine, or thread guide group, and wherein the threads are cut at a respective distance from the respective dispensing point and free to enter the thread aspirating device.

In an aspect the thread aspirating device is configured for maintaining a portion of each thread, from the respective dispensing point up to the free upper end, internally of the aspirating space (by effect of the aspiration) when the thread is not being worked on the needles of the knitting machine but is constrained to a device for supplying thread to the needles of the knitting machine, and is further configured for sucking in and expelling singly, from the aspirating opening, the respective portion of each thread previously aspirated into the aspirating space, when the thread returns to working on the needles of the knitting machine and the respective portion is cut by a cutting device.

In an aspect the thread aspirating device is destined to be mounted in a circular knitting machine, preferably of the seamless type, having a needle cylinder exhibiting a diameter preferably comprised between 4 inches and 40 inches and/or between 10 inches and 22 inches.

In an aspect, the present invention relates to a dial group for circular knitting machines, destined to be arranged superiorly of a needle cylinder of a knitting machine and comprising:

a support plate solidly constrained to the bearing structure and coaxial to the needle cylinder;

a thread transport and cutting organ, or cutter, rotatably mounted externally of the support plate;

a plurality of devices arranged on the support plate;

a plurality of thread aspirating devices according to one or more of the aspects and/or claims, wherein each thread aspirating device of the plurality of thread aspirating devices comprises a respective mouthpiece and a respective body of the thread aspirating device, having a measure selected according to the diameter of the needle cylinder of the knitting machine.

In an aspect, the present invention relates to a circular knitting machine comprising:

a bearing structure;

at least a needle-bearing organ or needle cylinder rotatably mounted in the bearing structure and having a respective diameter;

a plurality of needles supported by the needle cylinder and mobile parallel to a rotation axis of the needle cylinder so as to produce a knitted fabric;

a dial group connected to the bearing structure and arranged superiorly of the needle cylinder.

In an independent aspect, the present invention relates to a set of thread aspirating devices for circular knitting machines, the set comprising:

a plurality of bodies of the thread aspirating device each destined to realize a respective thread aspirating device, each body of the device having a lower side, destined to be mounted to a support plate of a dial group of a circular knitting machine and defining, in a mounted configuration to the support plate, an inlet opening configured for enabling inlet of one or more threads into the thread aspirating device, and an upper side provided with an engaging portion delimiting a passage opening in the upper side, and wherein each body of the thread aspirating device has the respective inlet opening thereof defined along a respective lateral edge of the body of the thread aspirating device, the lateral edge being destined to be positioned, with the thread aspirating device in the mounted configuration to the support plate of a dial group, at a portion of a perimeter edge of the support plate and superiorly thereof, so as to be superiorly aligned with a transport and cutting organ of the threads, or cutter, rotatably mounted externally of the support plate, and wherein the lateral edge of the body of the thread aspirating device has an arched conformation characterised by a determined radius of curvature and by a determined lateral extension, which define a device measure, the device measure being directly correlated to the diameter of the needle cylinder of the knitting machine to which the thread aspirating device is destined;

a plurality of mouthpieces each destined to realise a respective thread aspirating device, each mouthpiece having a substantially tubular conformation and extending between an open lower end, defining a mounting portion complementarily shaped to the engaging portion of the bodies of the thread aspirating device, and an upper end provided with an aspirating opening destined to be connected to an air aspirating device so as to generate a depression internally of the thread aspirating device and to realize an aspiration of one or more threads into the thread aspirating device by means of the inlet opening.

In an aspect the dimension and conformation of the engaging portion of all the thread aspirating devices of the plurality of bodies of the device is single and corresponds to the dimension of the mounting portion of all the mouthpieces of the plurality of mouthpieces.

In an aspect each mouthpiece is configured so as to be mountable superiorly to any body of the thread aspirating devices belonging to the plurality of bodies of the device, such that the respective mounting portion of the mouthpiece corresponds to the respective engaging portion of the body of the thread aspirating device and the mouthpiece and the body of the thread aspirating device internally define an aspirating space of the threads extending between the inlet opening and the aspirating opening, and wherein each mouthpiece and the respective body of the thread aspirating device overall form, in a reciprocal mounting condition, a thread aspirating device in a single body.

In an aspect, all the mouthpieces of the plurality of mouthpieces are structurally dimensioned and conformed in a single way, while the respective measure of each body of the thread aspirating device of the plurality of bodies of the thread aspirating device is selected from among a plurality of possible measures, each correlated to a diameter value of the needle cylinder of the knitting machine on which the body of the device is destined to be mounted. In other words, all the mouthpieces of the plurality of mouthpieces are identical to one another.

In an aspect, the set comprises:

at least a first group of thread aspirating devices made up of a first number of thread aspirating devices each comprising any mouthpiece of the plurality of mouthpieces and a body of the thread aspirating device having a first value of the measure and selected from the plurality of bodies of the aspirating device, the first group of thread aspirating devices being configured so as to be mounted in a circular knitting machine having a needle cylinder characterised by a respective first diameter value;

at least a second group of thread aspirating devices, distinct from the first group, made up by a second number of thread aspirating devices, each comprising any mouthpiece of the plurality of mouthpieces and a body of the thread aspirating device having a second value of the measure and selected from the plurality of bodies of the thread aspirating device, the second group of thread aspirating devices being configured so as to be mounted in a circular knitting machine having a needle cylinder characterised by a respective second diameter value;

the first and second value of the measure being selected from among the plurality of possible measures of the body of the thread aspirating device.

In an aspect the first and second value of the diameter of the needle cylinder are preferably comprised between 4 inches and 40 inches.

In an aspect the set comprises a plurality of thread aspirating devices having bodies of the thread aspirating devices and mouthpieces according to any one of the above aspects and/or the claims.

In an aspect the thread aspirating device is configured for contemporaneously aspirating a number of threads that is 1 or greater than 1 and/or 2 or greater than 2 and/or 4 or greater than 4 and/or 8 or greater than 8 and/or 12 or greater than 12.

In an independent aspect, the present invention relates to a method for realising thread aspirating devices for circular knitting machine, the method comprising steps of:

realising at least a body of the device having a lower side, destined to be mounted to a support plate of a dial group of a circular knitting machine and defining, in a mounted configuration to the support plate, an inlet opening configured for enabling inlet of one or more threads into the thread aspirating device, and an upper side provided with an engaging portion delimiting a passage opening in the upper side, and wherein the body of the aspirating device has the respective inlet opening defined along a lateral edge of the body of the aspirating device, the lateral edge being destined to be positioned, with the mouthpiece in the mounted configuration to the support plate of a dial group, at a portion of a perimeter edge of the support plate and superiorly thereof, such as to be superiorly aligned with a thread transport and cutting organ, or "cutter", rotatably mounted externally of the support plate, and wherein the lateral edge of the body of the thread aspirating device has an arched conformation characterised by a determined radius of curvature and a determined lateral extension, which define a device measure, the device measure being directly correlated to the diameter of the needle cylinder of the knitting machine to which the thread aspirating device is destined;

realising at least a mouthpiece having a substantially tubular conformation and extending between an open lower end, defining a mounting portion complementarily shaped to the engaging portion of the body of the thread aspirating device, and an upper end provided with an aspirating opening destined to be connected to an air aspirating device for generating a depression internally of the thread aspirating device and to realize an aspiration of one or more threads into the thread aspirating device through the inlet opening;

mounting the mouthpiece superiorly of the body of the thread aspirating device in such a way that the mounting portion of the mouthpiece corresponds to the engaging portion of the body of the thread aspirating device and the mouthpiece and the body of the aspirating device internally define an aspirating space of the threads extending between the inlet opening and the aspirating opening, the mouthpiece and the body of the aspirating device forming overall, in a condition of reciprocal mounting, a thread aspirating device in a single body.

In an aspect, during the steps of realising at least a body of the aspirating device and realising at least a mouthpiece, the dimension and conformation of the engaging portion of the at least a thread aspirating device is single and corresponds to the dimension of the mounting portion of the at least a mouthpiece, the mouthpiece being structurally dimensioned and conformed singly regardless of the diameter of the needle cylinder of the knitting machine to which the thread aspirating device is destined.

In an aspect, the step of realizing at least a body of the thread aspirating device comprises a step of selecting the measure of the at least a thread aspirating device among a plurality of possible measures, each correlated to a diameter value of the needle cylinder of the knitting machine on which the body of the thread aspirating device is destined to be mounted.

In an aspect the method comprises steps of:

realising a plurality of the bodies of the thread aspirating device, each destined to realise a respective thread aspirating device:

realising a plurality of the mouthpieces, each destined for realising a respective thread aspirating device;

realising, by means of a plurality of mounting steps, at least a first group of thread aspirating devices made up of a first number of thread aspirating devices each comprising any mouthpiece of the plurality of mouthpieces and a body of the thread aspirating device having a first value of the measure and selected from the plurality of bodies of the thread aspirating device, the first group of thread aspirating devices being configured so as to be mounted in a circular knitting machine having a needle cylinder characterised by a respective first diameter value;

realising, by means of the plurality of the mounting steps, at least a second group of thread aspirating devices, distinct from the first group, made up by a second number of thread aspirating devices, each comprising any mouthpiece of the plurality of mouthpieces and a body of the thread aspirating device having a second value of the measure and selected from the plurality of bodies of the thread aspirating device, the second group of thread aspirating devices being configured so as to be mounted in a circular knitting machine having a needle cylinder characterised by a respective second diameter value;

wherein the first and second value of the measure are selected from among the plurality of possible measure of the body of the thread aspirating device.

In an aspect the method comprises steps of realising a third group of thread aspirating devices and/or a fourth group of thread aspirating devices and/or further groups of thread aspirating devices. In an aspect each first and second and/or third group of thread aspirating devices comprises a respective number, as desired, of thread aspirating devices. In an aspect the step of realising at least a body of the thread aspirating device comprises a step of casting or die-casting a quantity of a metal material for realising the body of the thread aspirating device.

In an aspect the step of realising at least a mouthpiece comprises a step of moulding, preferably by injection, a quantity of a plastic and/or polymer material for realising the mouthpiece.

In an aspect the circular knitting machine is of the seamless type.

In a further independent aspect, the present invention relates to a thread aspirating device for circular knitting machines, comprising:

a lower base, destined to be mounted to a support plate of a dial group of a circular knitting machine, the base defining, in a mounted configuration to the support plate, at least an inlet opening configured for enabling inlet of one or more threads in the thread aspirating device;

an aspirating opening, positioned superiorly and destined to be connected to an air aspirating device so as to generate a depression internally of the thread aspirating device and to realize an aspiration of one or more threads into the thread aspirating device through the inlet opening;

an aspirating space of the threads extending internally of the thread aspirating device between the inlet opening and the aspirating opening, wherein the thread aspirating device is configured for aspirating internally thereof and maintain one or more infeed threads for a knitting machine in the aspirating space.

In an aspect, the thread aspirating device comprises at least a thread separating element or "grommet" positioned internally of the aspirating space and interposed between the inlet opening and the aspirating opening, the separating element intercepting the aspirating space at a transversal or horizontal section thereof, wherein the separating element defines a plurality of seatings each configured for internally containing at least an infeed thread when the thread is internal of the aspirating space.

In an aspect, the plurality of seatings is configured for maintaining the threads of a respective plurality of threads present in the aspirating space separate, preventing reciprocal contacts between different threads and/or preventing knotting and tangling among different threads.

In an aspect the separating element of the threads can house a variable number of threads of the knitting machine, and/or can contain one or more threads in each of the seatings, and/or can contain threads only in some of the seatings.

In an aspect each seating of the plurality of seatings of the separating element is destined to contain internally one and one only respective infeed thread, or one or more seatings of the plurality of seatings of the separating element is destined to contain internally thereof a plurality of infeed threads, for example two infeed threads. In an aspect the plurality of seatings of the separating element comprises at least two distinct seatings and/or at least four distinct seatings and/or at least eight distinct seatings and/or at least twelve distinct seatings.

In an aspect the section, in which the separating element intercepts the aspirating space, lies on a transversal plane, preferably perpendicular, to an aspirating direction of the threads directed, in the aspirating space, from the inlet opening to the aspirating opening.

In an aspect the separating element is realised as a separate body and is inserted internally of the thread aspirating device, in the aspirating space, and fixed in a determined position to the thread aspirating device.

In an aspect the separating element has a ring conformation, or a conformation of a portion of ring and comprises:

- an upper side facing towards the aspirating opening;
- a lower side, opposite the upper side and facing towards the inlet opening;
- an external wall, destined to be associated to an internal surface of the thread aspirating mouthpiece;
- a passage opening interposed between the upper side and the lower side, destined to be crossed by the one or more infeed threads of the knitting machine, wherein the plurality of seatings of the separating element is defined in the passage opening, wherein the passage opening is destined to be crossed, from the lower side to the upper side, by the one or more threads by effect of the aspiration, so that the one or more threads are positioned in the plurality of seatings, preferably each single seating containing a single infeed thread, such that each thread, during the aspiration, moves limitedly to the inside of the respective seating, staying internal thereof and not entering into contact, at least at the passage opening, with the further threads crossing the separating element.

In an aspect the seatings of the plurality of seatings are completely distinct from one another and each delimit a respective independent through-hole between the lower side and the upper side, in this case the separating element assuming a conformation with a separating wall provided with a plurality of holes.

In an aspect the separating element comprises a plurality of protuberances emerging singly from the wall and developing in the passage opening, such that between each pair of adjacent protuberances a seating is defined of the plurality of seatings.

In an aspect each seating, defined between a pair of adjacent protuberances, is partially open in, and communicating with, the passage opening of the separating element.

In an aspect, the passage opening is single for the whole separating element and is shaped such as to define the said protuberances and to realise the plurality of distinct seatings, the distinct seatings constituting in this case portions of the passage opening.

In an aspect the protuberances of the plurality of protuberances emerge, developing in the passage opening, at distinct positions of the wall of the separating element, the positions being circularly distributed along an angular portion of the wall or along the whole circular extension of the wall.

In an aspect, the wall of the separating element is in contact with the internal surface of the thread aspirating device, so at to entirely intercept the section of the aspirating spaces.

In an aspect the thread aspirating device comprises:

- a body of the thread aspirating device, coinciding with the lower base, and defining the above-mentioned inlet opening;
- a mouthpiece, having a substantially tubular conformation, positioned above the body of the thread aspirating device and solidly constrained thereto, the mouthpiece being superiorly provided with the aspirating opening, wherein the mouthpiece and the body of the thread aspirating device overall form, in a reciprocally mounted condition, a thread aspirating device in a single body and overall internally define the thread aspirating space.

In an aspect the separating element is positioned internally of the mouthpiece.

In an aspect the body of the thread aspirating device and the mouthpiece are made in a single piece, or they are made as two distinct bodies reciprocally mounted to one another, with the mouthpiece mounted superiorly of the body of the thread aspirating device, so as to form a thread aspirating device in a single body.

Each of the above aspects of the invention can be taken alone or in combination with any one of the claims or the other aspects described.

Further characteristics and advantages will more fully emerge from the detailed description that follows of some embodiments thereof, among which a preferred embodiment, given by way of non-exclusive example, of a thread aspirating device for circular knitting machines according to the present invention. This description will be set out in the following with reference to the accompanying tables of the drawings, provided purely by way of non-limiting example, in which.

Figure 1:
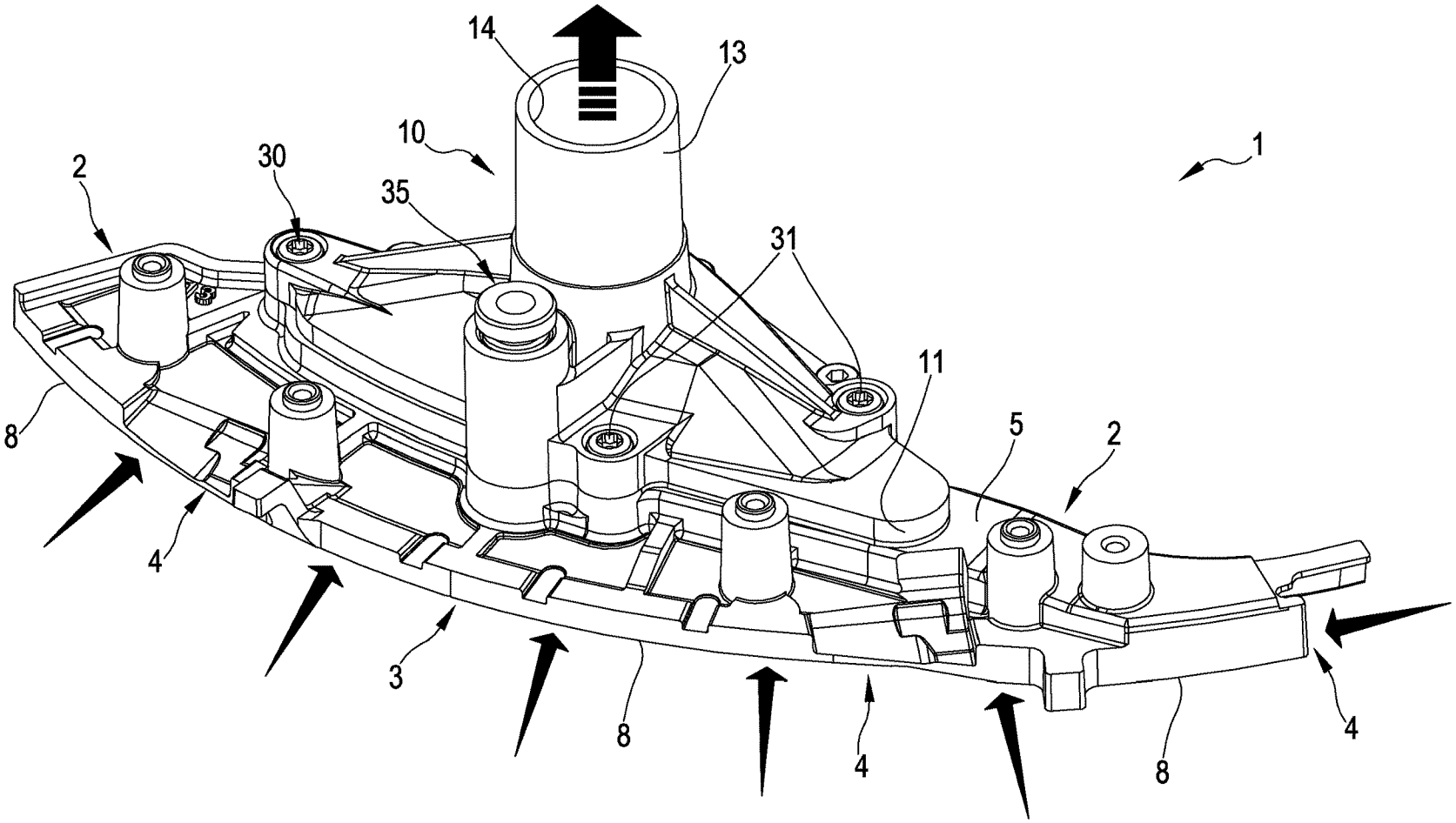
FIG. 1 is a perspective view of a possible embodiment of a thread aspirating device for circular knitting machines according to the present invention.

With reference to the figures of the drawings, reference numeral 1 denotes in its entirety a thread aspirating device according to the present invention, while number 100 denotes in its entirety the dial group of a knitting machine. In general, the same reference numeral is used for elements that are identical or alike, including possibly in their various embodiments.

Figure 10:
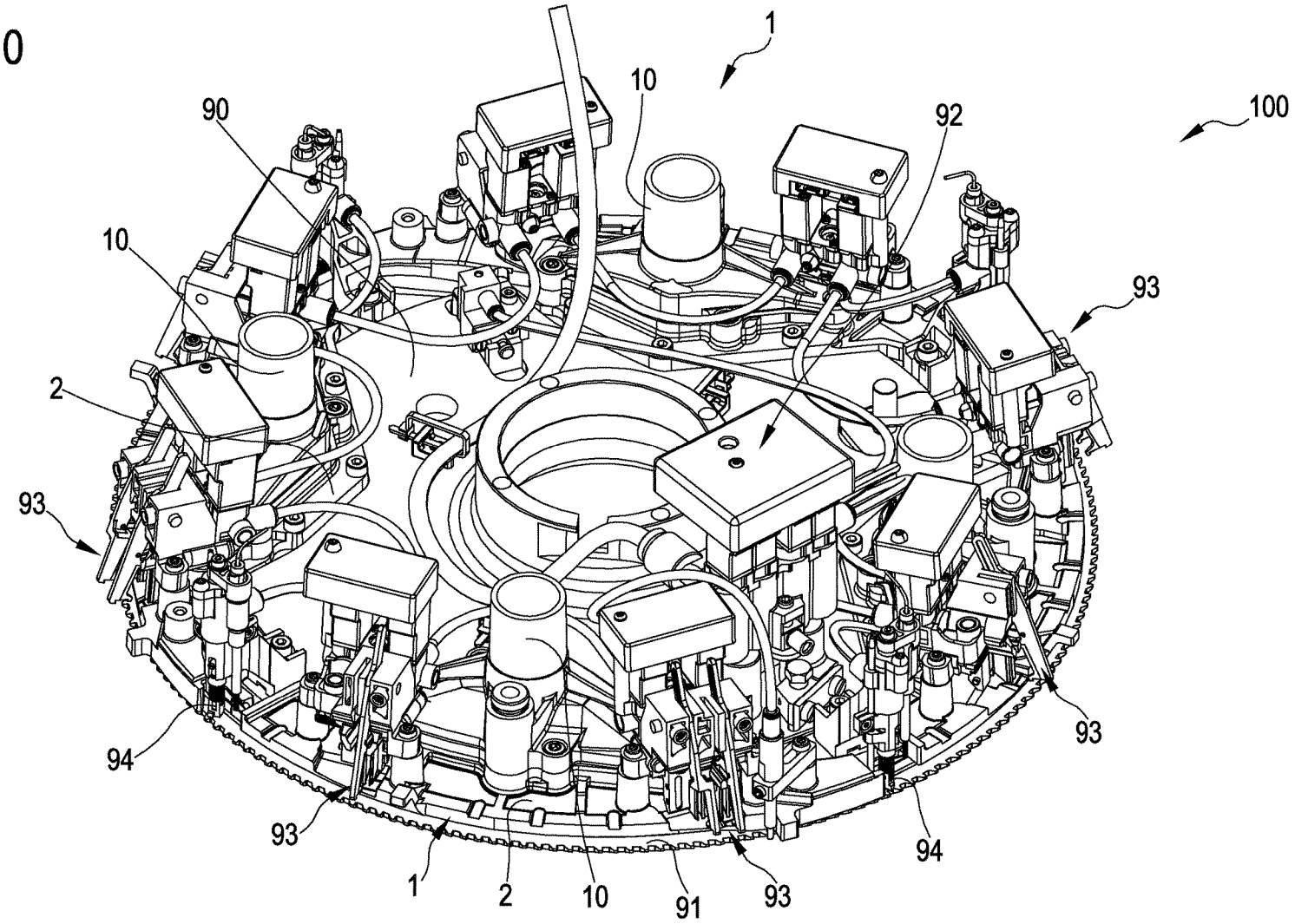
FIG. 10 is an example of a dial group of a knitting machine, comprising a plurality of thread aspirating devices according to the present invention.

FIGS. 1-6 illustrate a possible embodiment of a thread aspirating device according to the present invention, while FIG. 10 illustrates a dial group comprising a plurality of thread aspirating devices according to the present invention. The base of the knitting machine, the section comprising the processing board, the knitting head comprising the needle-bearing organ, the needles and other parts of the knitting machine are not shown in detail in the figures, as they are of known type, and of conventional type. From a point of view of the knitting industry, the functioning of the whole knitting machine (for example the functioning of the knitting head, the cooperation among needles and threads, etc.) is not described in detail, being known to an expert in the sector of the present invention.

Figure 2:
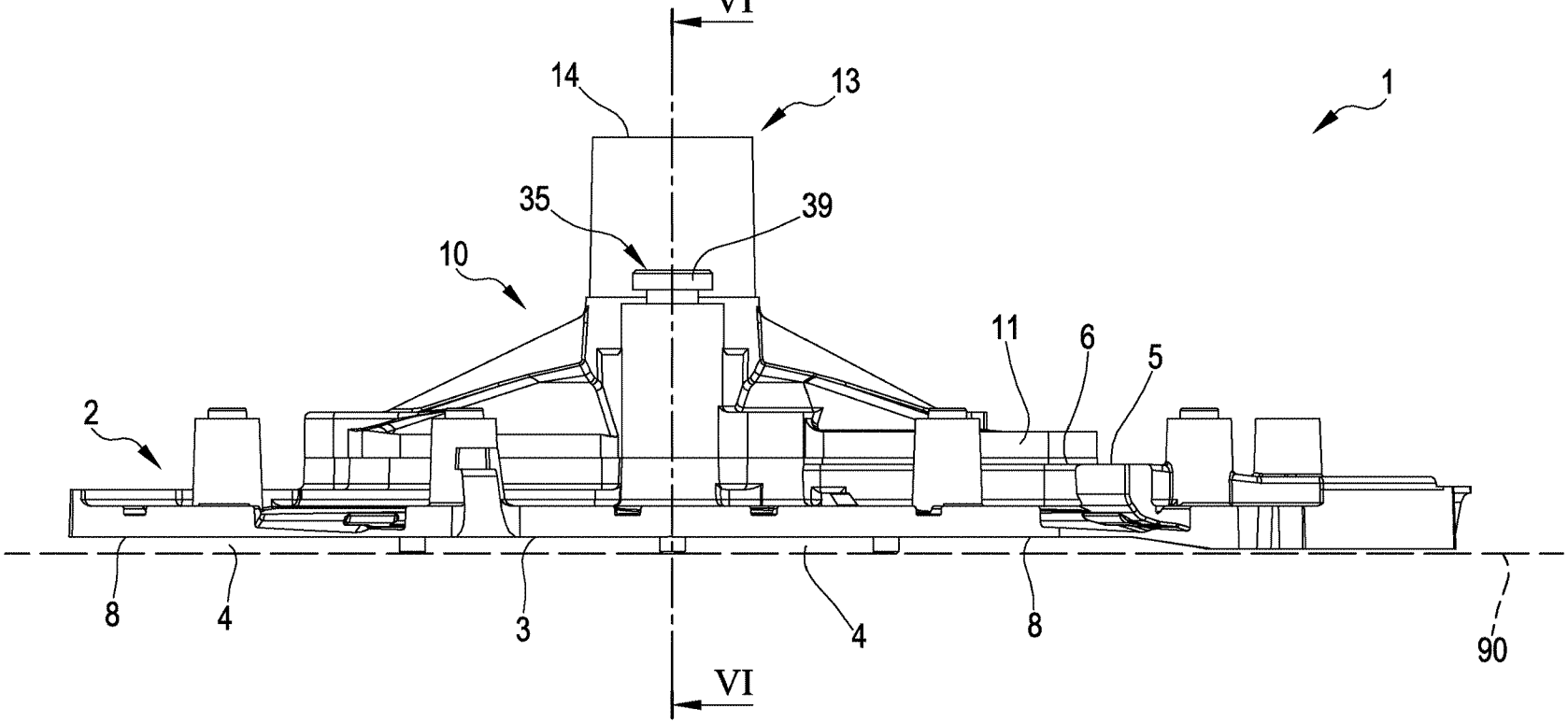
FIG. 2 is a lateral view of a thread aspirating device of FIG. 1.
Figure 3:
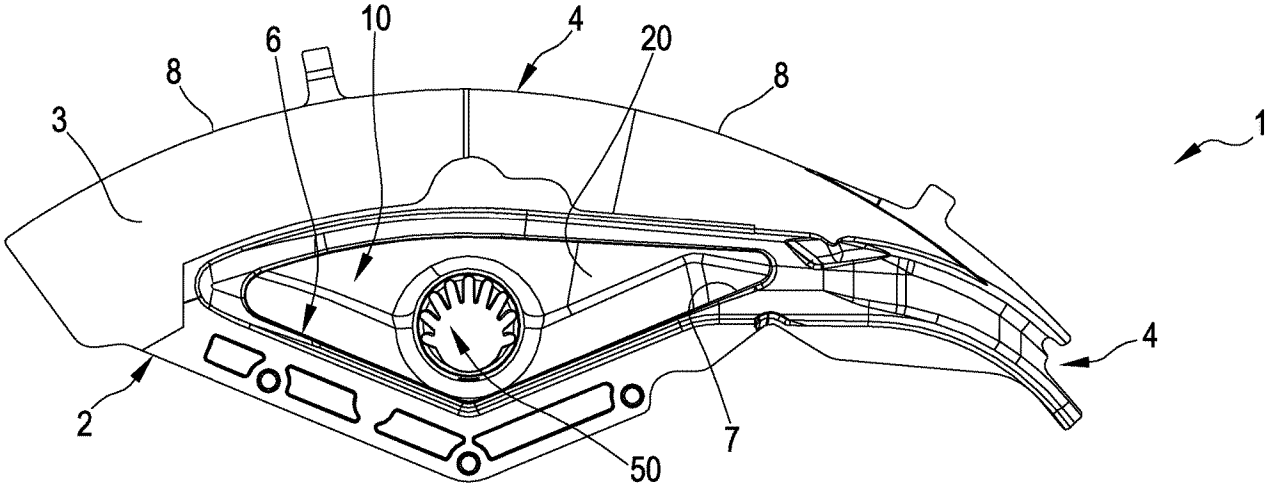
FIG. 3 is a plan view from below of the thread aspirating device of FIG. 1.
Figure 4:
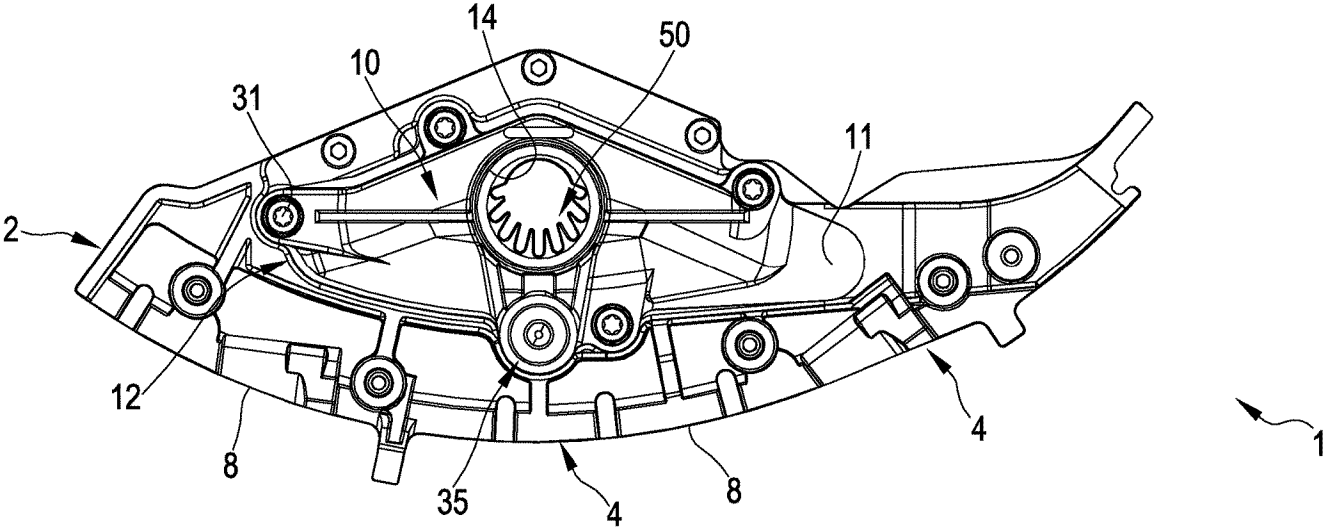
FIG. 4 is a plan view from above of the thread aspirating device of FIG. 1.
Figure 6:
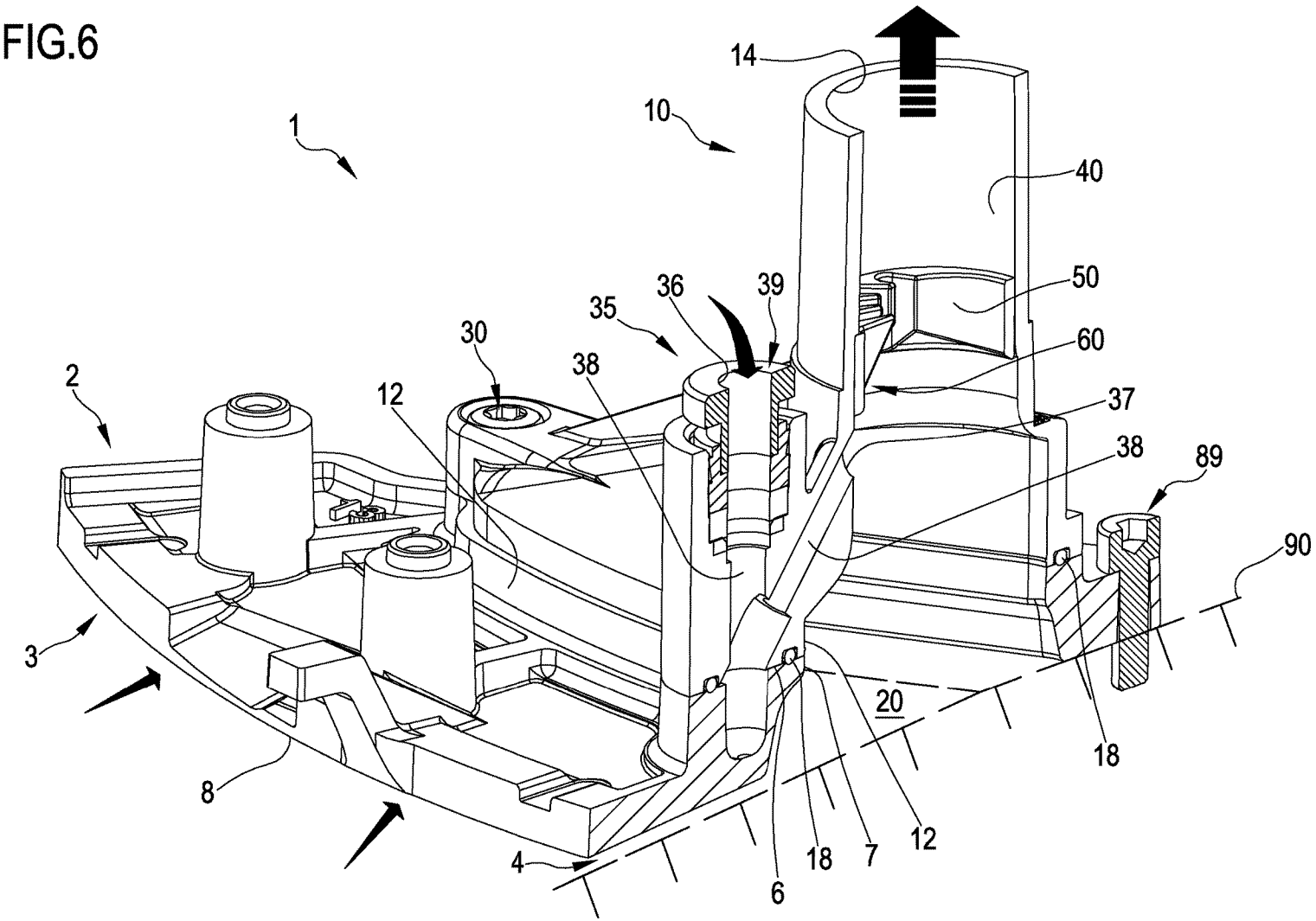
FIG. 6 is a perspective section view of the thread aspirating device of FIG. 1, sectioned along line VI-VI.

The thread aspirating device 1 for circular knitting machines comprises a body 2 of the aspirating device having a lower side 3 destined to be mounted to a support plate 90 of a dial group 100 of a circular knitting machine and defining, in the mounted configuration to the support plate, at least an inlet opening 4 configured for enabling inlet of one or more threads of the thread aspirating device. The mounted configuration is schematically illustrated in FIGS. 1, 2 and 6, in which it is possible to observe how the supporting and mounting of the body 2 to the support plate 90 enable defining a slit between the lower side 3 and the plate 90, the slit constituting the above-mentioned inlet opening 4.

Figure 5:
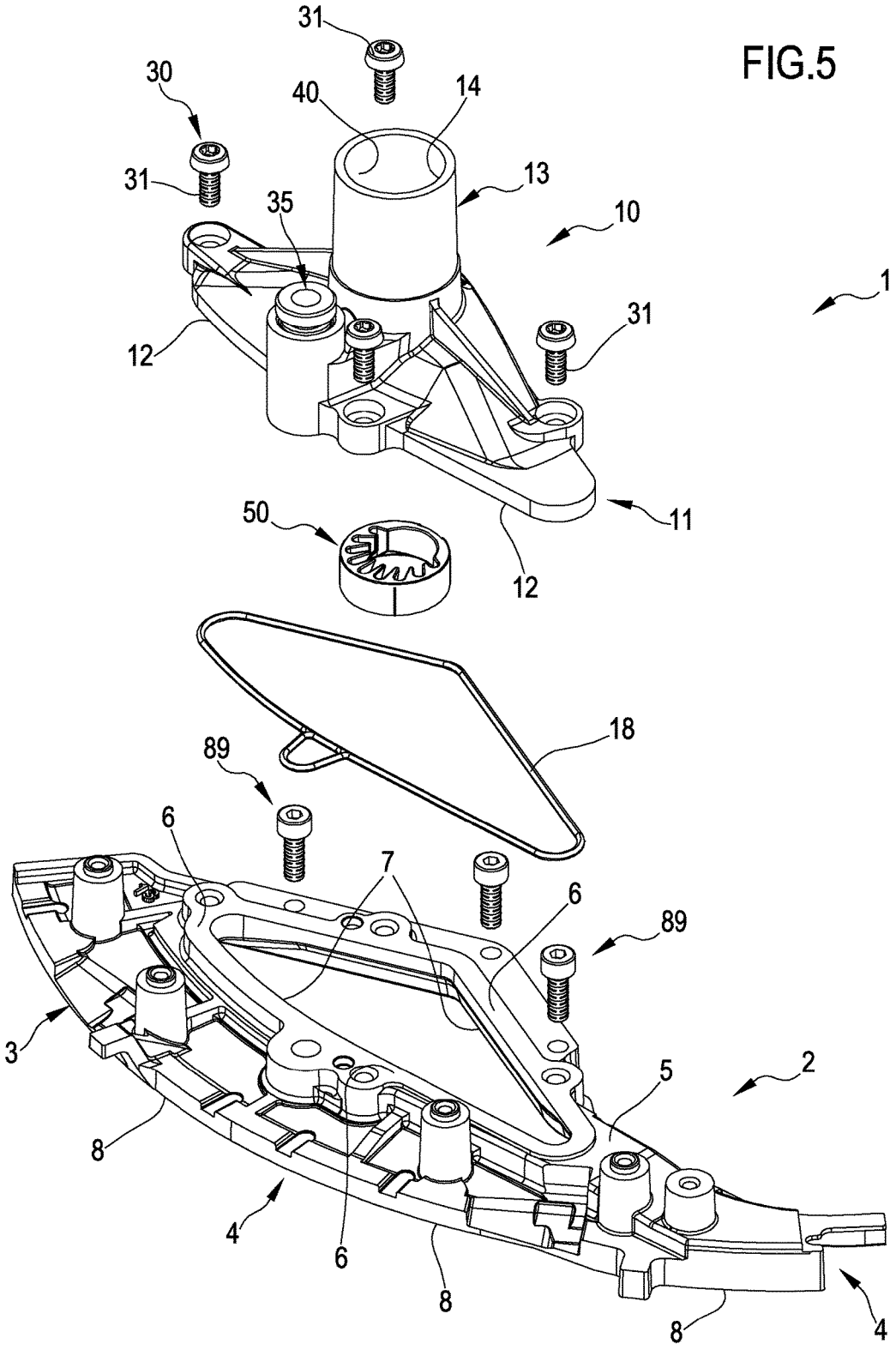
FIG. 5 is an exploded perspective view of the thread aspirating device of FIG. 1.

The body 2 of the thread aspirating device further exhibits an upper side 5, provided with an engaging portion 6 delimiting a passage opening 7 of the upper side (the opening is clearly visible in FIG. 5). The thread aspirating device 1 further comprises a mouthpiece 10, distinct from the body of the aspirating device, having a substantially tubular conformation and extending between an open lower end 11, defining a mounting portion 12 complementarily shaped to the engaging portion 6 of the body of the device, and an upper end 13 provided with an aspirating opening 14. The aspirating opening 14 is destined to be connected to an air aspirating device (not illustrated, of known type) for generating a depression internally of the thread aspirating device and realize an aspiration of one or more threads into the thread aspirating device via the inlet opening 4. In substance, the predisposing of a vertical aspiration at the aspirating opening 14 realises an upwards air draw internally of the thread aspirating device, which in turn determines an aspirating effect from outside at the inlet opening 4. The aspirating opening can be connected to the air aspirating device by means of an aspirating tube (not shown).

The mouthpiece 10 is superiorly mounted on the body 2 of the mouthpiece in such a way that the mounting portion 12 of the mouthpiece corresponds to the engaging portion 6 of the body of the thread aspirating device, and the mouthpiece and the body of the aspirating device internally define an aspirating space 20 of the threads, extending between the inlet opening 4 and the aspirating opening 14.

The mouthpiece 10 and the body 2 of the thread aspirating device overall form, in the reciprocal mounted condition, a thread aspirating device 1 in a single body configured for aspirating internally thereof and maintain, in the aspirating space 20, one or more threads infeeding to the knitting machine.

Note, as shown in FIG. 10, that the thread aspirating device 1 is destined to be positioned in the dial group 100 of a knitting machine, with the aim of sucking one or more threads and the relative fluff. In greater detail, the inlet opening 4 is configured for determining inlet of one or more threads into the thread aspirating device by effect of the above-mentioned aspiration: the threads are inferiorly constrained, at a respective dispensing point, to a device for feeding thread to the needles of the knitting machine, or thread guide group, and wherein the threads are cut at a respective distance from the respective dispensing point and are free to enter the thread aspirating device.

In substance each thread, when not being worked, exhibits a free length which extends for a variable length beyond the respective thread guide to which it is associated. This free length of each thread is in substance a portion which starts from the respective dispensing point and terminates at the free upper end.

In this situation, the thread aspirating deice is able to keep the free portion of each thread internally of the aspirating space (by effect of the aspiration) when the thread is not being worked on the needles of the knitting machine but is constrained to a device for feeding thread to the needles of the knitting machine (thread guide). When a thread is ready to return into the working mode on a needle of the cylinder, the free portion thereof has to be cut, so as to trim the thread and predispose it, without free lengths, to form new knitting stitches. With this aim, the thread aspirating device is able to suck and expel singly, from the aspirating opening, the respective portion of each thread previously aspirated in the aspirating space, when the thread returns to work on the needles of the knitting machine and the respective length is cut by a cutting device (or "knife") cooperating with the cutter.

With reference to FIGS. 1-6, the inlet opening is defined along a lateral edge 8 of the body 2 of the device: the lateral edge being destined to be positioned, with the device in the mounted configuration to the support plate 90 of a dial group 100, at a portion of a perimeter edge of the support plate and superiorly thereof, in such a way as to be superiorly aligned with a thread transport and cutting organ, or "cutter", rotatably mounted externally of the support plate.

The lateral edge 8 of the body 2 of the thread aspirating device preferably has an arched conformation characterised by a determined radius of curvature and a determined lateral extension, which define a "device measure". The device measure is preferably directly correlated to the diameter of the needle cylinder of the knitting machine to which the thread aspirating device is destined.

The radius of curvature of the lateral edge 8 of the body 2 of the thread aspirating device is preferably substantially equal to, or proportional to, half the diameter of the needle cylinder of the knitting machine to which the thread aspirating device is destined.

The determined lateral extension of the lateral edge 8 is preferably substantially equal to the distance between two adjacent thread feeders, or thread feeding points, of the knitting machine, or is substantially equal to a thread feeder.

The above-mentioned device measure preferably increases with an increase of the diameter of the needle cylinder of the knitting machine on which the body of the aspirating device is destined to be mounted, in particular the radius of curvature and/or the lateral extension of the lateral edge increase.

The mouthpiece 10 is preferably structurally dimensioned and conformed in a single way, in particular as regards the shape and dimensions of the mounting portion 12, regardless of the diameter of the needle cylinder of the knitting machine to which the thread aspirating device is destined. On the contrary, the body 2 of the thread aspirating device, to which the mouthpiece 10 is able to be mounted, is selected from among a plurality of possible thread aspirating devices.

The thread aspirating device bodies have in common the shape and dimensions of the engaging portion 6, complementarily shaped to the mounting portion 12, and differ in terms of the relative measure of the thread aspirating device, which can be selected without modifying the structure and/or the dimensions of the mouthpiece 10.

The body 2 of the device and the mouthpiece 10 are preferably made of different materials. The body of the thread aspirating device is preferably entirely made of a single material, and the mouthpiece is entirely made of a single respective material. The body 2 of the thread aspirating device is made of a metal material, preferably iron, zinc, aluminium, cast iron, steel, or alloys thereof (for example zamak, zinc alloy and aluminium).

The mouthpiece 10 is preferably made of a plastic material, more preferably a polymer material and/or a plastic material comprising a percentage of carbon (or another similar element, or fibreglass) preferably being at least 10% in weight and/or 20% in weight and/or 30% in weight (by weight percentage is meant carbon percentage of the total weight used to make the mouthpiece).

The body 2 of the thread aspirating device preferably comprises a surface cladding layer containing nickel or obtaining by a nickeling treatment, the surface layer covering at least a portion of the external surface of the body of the thread aspirating device, preferably the whole external surface of the body of the thread aspirating device.

As shown by way of example in the figures, the thread aspirating device preferably comprises at least a seal element 18 interposed between, and in contact with, the mounting portion 12 of the mouthpiece 10 and the engaging portion 6 of the body 2 of the thread aspirating device. The sealing element 18 is configured so as to guarantee an air seal between the mouthpiece and the body of the thread aspirating device, when the thread aspirating device is mounted. The seal element is interposed between the body 2 and the mouthpiece 10 during assembly of the thread aspirating device. The seal element is preferably a gasket, for example a rubber gasket.

The inlet opening 4 of the body 2 of the thread aspirating device is preferably provided, at a lateral end thereof, with a terminal aspirating portion, destined to be, with the mouthpiece in the mounted position to the support plate of a dial group, in proximity of a cutting device, or "cutter", of the dial group. The terminal aspirating portion preferably has a "spout" shape configured for maximizing the aspiration at the cutter. The terminal portion advantageously enables having an effective aspirating at the point where the free portion of the threads is cut by the cutter: in this way, once the cut has been performed, the thread aspirating device is able to effectively aspirate the cut portion of thread from the spout-shaped terminal portion.

The thread aspirating device 1 preferably comprises assembling means 30 configured so as to mount, preferably removably, the mouthpiece 10 to the body 3 of the thread aspirating device, in such a way that the mounting portion 12 is coupled to the engaging portion 6. The assembling means 30 comprise one or more screws 31 (as shown by way of example in the figures) or one or more hooks or a weld joint or a glue or the like.

The thread aspirating device 1 can preferably comprise at least an inlet 35 for a flow of compressed air, the inlet developing between an inlet hole 36, open externally of the thread aspirating device and destined to be pneumatically connected, for example by means of a tube, to a compressed air source, and an injecting hole 37 open into the aspirating space 20, in such a way that the compressed air flow injects into the aspirating space, generating an additional air aspiration towards the aspirating opening 14 of the mouthpiece and/or generating an air movement, preferably turbulent, internally of the aspirating space. The inlet 35 enables sending internally of the aspirating space, and selectively, an air flow able to strike the threads present in the aspirating space and facilitate expulsion thereof, preventing tangling and/or knotting among the threads. The inlet 35 further enables realizing, when required, a cleaning of the aspirating space.

The inlet hole 36 and the injecting hole 37 are preferably made in the mouthpiece 10. The mouthpiece 10 and/or the body of the thread aspirating device preferably comprise an internal conduit 38 connecting the inlet hole 36 to the injecting hole 37. The inlet 35 for an air flow preferably comprises, at the inlet hole, a rapid coupling 39, or in general a connection fitting for a compressed air tube.

The aspirating space 20 is preferably shaped in such a way as to guide the threads from the inlet opening 4 towards the aspirating opening 14 along a curved pathway, internal of the thread aspirating device; the curved pathway is substantially free of live edges or rapid changes of inclination and is characterised by a substantially continuous and/or connected profile.

The body 2 of the thread aspirating device preferably has a height, calculated as a vertical distance between the lower side 3 and the upper side 5, or between the inlet opening 4 and the passage opening 14, and the mouthpiece 10 has a respective height, calculated as the vertical distance between the lower end 11 of the mouthpiece and the aspirating opening 14. The thread aspirating device 1 is characterised by an overall height, calculated as a maximum vertical dimension or size between the aspirating opening 14 and the lower side 3, or between the aspirating opening 14 and the inlet opening 4, which is equal to the sum of the height of the body of the thread aspirating device and the respective height of the mouthpiece. The height of the body 2 of the thread aspirating device is preferably smaller than 50% or 40% or 30% or 20% or 10% of the overall height.

The mounting portion 12 of the mouthpiece 10 and the engaging portion 6 of the body 2 of the thread aspirating device, coinciding when the thread aspirating device is mounted, preferably define an intermediate plane of the thread aspirating device. The intermediate plane is preferably horizontal and/or parallel to the aspirating opening 14 and/or parallel to the lower side 3. The intermediate plane is preferably located at a distance from the lower side 3 of the body 2 of the thread aspirating device that is smaller than the distance from the aspirating opening 14 of the mouthpiece. The intermediate plane is preferably located at a distance from the lower side 3 of the body 2 of the thread aspirating device that is equal to an amount comprised between 5% and 50% of the overall height, and at a respective distance from the aspirating opening 14 of the mouthpiece 10 that is equal to an amount comprised respectively between 95% and 50% of the overall height.

In an aspect the body of the thread aspirating device has an overall conformation that is substantially plate-shaped and mainly develops on a horizontal plane.

In an aspect the mouthpiece has an overall funnel conformation, with a tubular upper portion, superiorly defining the aspirating opening, and a lower portion solidly constrained to, preferably in a single piece with, the upper portion and terminating inferiorly with the mounting portion, the lower portion having a conical shape and progressively broadening from the upper portion towards the mounting portion.

In an aspect the aspirating opening, and preferably the upper portion of the mouthpiece, has a substantially circular section having a diameter comprised between 5 mm and 100 mm and/or comprised between 10 mm and 70 mm and/or comprised between 20 mm and 50 mm.

The thread aspirating device of the present invention is destined to be mounted in a circular knitting machine, preferably of the seamless type, having a needle cylinder exhibiting a diameter preferably comprised between 4 inches and 40 inches and/or between 10 inches and 22 inches.

The body 2 of the thread aspirating device is destined to be mounted at a thread feeding point or thread feeder of the knitting machine or (as shown by way of example in FIG. 10) shared between two or more adjacent thread feeders.

The present invention further comprises a dial group for circular knitting machines, destined to be arranged superiorly of a needle cylinder of a knitting machine and comprising:

- a support plate 90 solidly constrained to a bearing structure (not shown) of the knitting machine and coaxial to the needle cylinder;
- a thread transport and cutting organ, or cutter 91, rotatably mounted externally of the support plate 90;
- a plurality of devices arranged on the support plate;
- a plurality of thread aspirating devices 1 according to the present invention;
- wherein each thread aspirating device of the plurality of thread aspirating devices comprises a respective mouthpiece and a respective body of the thread aspirating device, the latter having a measure selected according to the diameter of the needle cylinder of the knitting machine.

The present invention further relates to a set (or assembly) of thread aspirating devices for circular knitting machines, the set comprising:

- a plurality of bodies of the thread aspirating device each destined to realize a respective thread aspirating device, each body of the device being of the above-described type and illustrated in FIGS. 1-6, in which each body 2 has a respective aspirating mouth measure, defined by a determined radius of curvature and a determined lateral extension, wherein the device measure is directly correlated to the diameter of the needle cylinder of the knitting machine to which the thread aspirating device is destined;
- a plurality of mouthpieces each destined to realise a respective thread aspirating device, each mouthpiece being of the above-described type and shown in FIGS. 1-6.

Internally of the set, the dimension and the conformation of the engaging portion 6 of all the bodies 2 of the above-mentioned plurality of bodies of the thread aspirating device is single and corresponds to the dimension of the mounting portion 12 of all the mouthpieces 10 of the above-mentioned plurality of mouthpieces; further, each mouthpiece is configured so as to be mountable superiorly to any body of the thread aspirating device belonging to the plurality of bodies of the thread aspirating device, so that the respective mounting portion of the mouthpiece corresponds with the respective engaging portion of the body of the thread aspirating device and each mouthpiece and the respective body of the thread aspirating device overall form a thread aspirating device in a single body when assembled.

In substance, all the mouthpieces of the set are structurally dimensioned and conformed in a single way (i.e. they are identical to one another), while the respective measure of each thread aspirating device body of the set is selected from among a plurality of possible measures, each correlated to a diameter value of the needle cylinder of the knitting machine on which the body of the thread aspirating device is destined to be mounted.

In a first embodiment, the set comprises the thread aspirating devices destined for a single knitting machine provided with a cylinder having a determined diameter.

In a possible embodiment, the set comprises:

- at least a first group of thread aspirating devices made up of a first number of thread aspirating devices each comprising any mouthpiece of the plurality of mouthpieces and a body of the thread aspirating device having a first value of the measure and selected from among the plurality of bodies of the thread aspirating device; the first group of thread aspirating devices is configured so as to be mounted in a circular knitting machine having a needle cylinder characterised by a respective first diameter value;
- at least a second group of thread aspirating devices, distinct from the first group, made up by a second number of thread aspirating devices, each comprising any mouthpiece of the plurality of mouthpieces and a body of the thread aspirating device having a second value of the measure and selected from among the plurality of bodies of the thread aspirating device; the second group of thread aspirating devices is configured so as to be mounted in a circular knitting machine having a needle cylinder characterised by a respective second diameter value.

The first and the second value of measure are selected from among a plurality of possible measures of the body of the thread aspirating device.

In substance, the set comprises at least two groups (each having a respective number) of thread aspirating devices. All the thread aspirating devices of the set, regardless of the group they belong to, are provided with a same mouthpiece, i.e. the mouthpiece does not change between thread aspirating devices belonging to different groups. On the contrary, the bodies of the thread aspirating groups are identical internally of a same group, but differ—in the measure thereof—between one thread aspirating devices group and another.

In this case the set comprises destining the first thread aspirating devices group to a first machine (having a needle cylinder characterised by a first diameter), while the second group of thread aspirating devices is destined to a second knitting machine (having a needle cylinder characterised by a second diameter).

The present invention further relates to a method for realising the thread aspirating devices for circular knitting machines; the method enables realising the set of thread aspirating devices, by means of following steps:

- realising a plurality of the bodies of the thread aspirating device, each destined to realise a respective thread aspirating device:

realising a plurality of the mouthpieces, each destined to realise a respective thread aspirating device, all identical to one another;

realising, by means of a plurality of mouthpiece-thread aspirating device body, a first group of thread aspirating devices made up of a first number of thread aspirating devices each comprising any mouthpiece of the plurality of mouthpieces and a body of the thread aspirating device having a first value of the measure and selected from the plurality of bodies of the thread aspirating device, realising, by means of a further series of mounting steps of couples mouthpiece-thread aspirating device body, at least a second group of thread aspirating devices, distinct from the first group, made up by a second number of thread aspirating devices, each comprising any mouthpiece of the plurality of mouthpieces and a body of the thread aspirating device having a second value of the measure and selected from the plurality of bodies of the thread aspirating device, wherein the first and second value of the measure are selected from among the above-mentioned plurality of possible measures of the body of the thread aspirating device.

There follows a description of a further embodiment of a thread aspirating device according to the present invention, with particular reference to FIGS. 3-9.

The thread aspirating device comprises:

a lower base 3, destined to be mounted to a support plate of a dial group of a circular knitting machine, the base defining, in a mounted configuration to the support plate, at least an inlet opening 4 configured for enabling inlet of one or more threads into the thread aspirating device;

an aspirating opening 14, positioned superiorly and destined to be connected to an air aspirating device so as to generate a depression internally of the thread aspirating device and to realize an aspiration of one or more threads into the thread aspirating device through the inlet opening;

an aspirating space 20 of the threads extending internally of the thread aspirating device between the inlet opening and the aspirating opening;

wherein the thread aspirating device comprises at least a thread separating element 50 or "grommet" 50 positioned internally of the aspirating space and interposed between the inlet opening and the aspirating opening, the separating element intercepting the aspirating space 20 at a transversal or horizontal section thereof.

The separating element 50 defines a plurality of seatings 51 each configured for internally containing at least an infeed thread when the thread is internal of the aspirating space.

The plurality of seatings 51 is configured for maintaining the threads of a respective plurality of threads present in the aspirating space separate, preventing reciprocal contacts between different threads and/or preventing knotting and tangling among different threads.

The separating element 50 of the threads can be comprised in a thread aspirating device of the above-described type (i.e. provided with a mouthpiece and a thread aspirating device body distinct from one another and assembled) or, advantageously, the separating element 50 can be added to a thread aspirating device of known type (for example a thread aspirating device in a single piece).

The separating element 50 of the threads can house a variable number of threads of the knitting machine; it can for example contain one or more threads in each of the seatings, and/or can contain threads only in some of the seatings (in which case some seatings are free of threads internally thereof).

Figure 7:
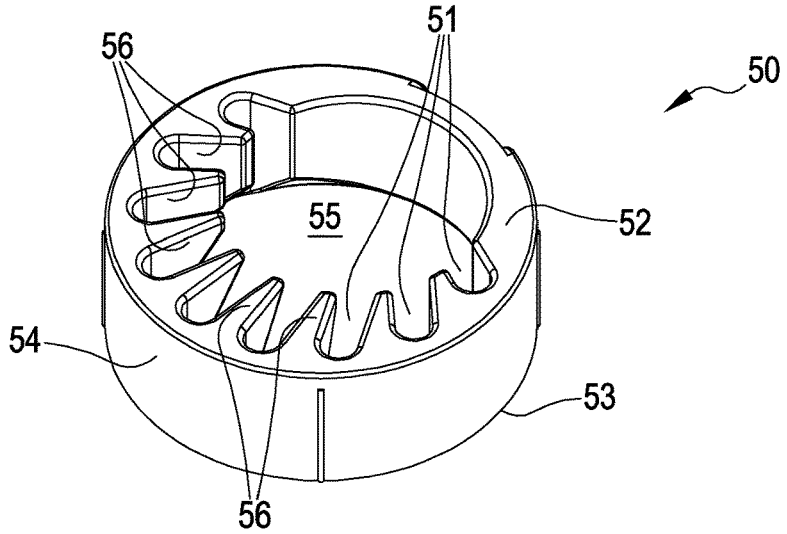
FIG. 7 is an upper perspective view of an embodiment of a separating element for thread aspirating devices according to the present invention.
Figure 8:
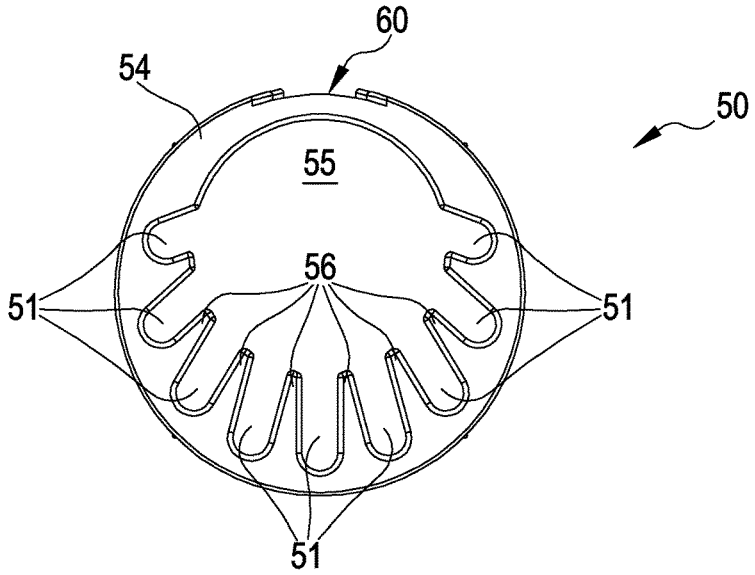
FIG. 8 is a plan view of the separating element of FIG. 7.
Figure 9:
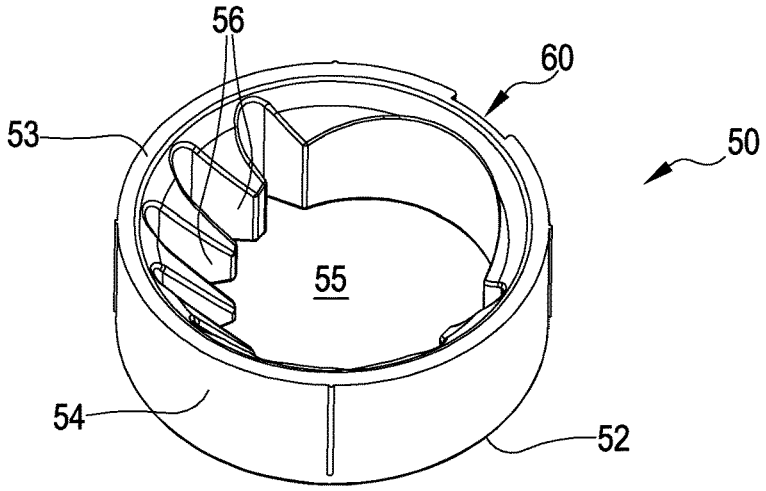
FIG. 9 is a perspective view from below of the separating element of FIG. 7.

The plurality of seatings 51 of the separating element preferably comprises at least two distinct seatings and/or at least four distinct seatings and/or at least eight distinct seatings and/or at least twelve distinct seatings. In FIGS. 7-9, which illustrate an embodiment by way of example, nine different seatings 51 can be distinguished.

The above-mentioned section, in which the separating element 50 intercepts the aspirating space 20, preferably lies on a transversal plane, preferably perpendicular, to an aspirating direction of the threads directed, in the aspirating space, from the inlet opening to the aspirating opening.

As shown in the figures, the separating element 50 is preferably realised as a separate body and is inserted internally of the thread aspirating device 1, in the aspirating space 20, and fixed in a determined position to the thread aspirating device.

The separating element 50 preferably has a ring conformation, or a conformation of a portion of ring and comprises:

an upper side 52, facing towards the aspirating opening 14;

a lower side 53, opposite the upper side and facing towards the inlet opening 4;

an external wall 54, destined to be associated to an internal surface 40 of the thread aspirating mouthpiece;

a passage opening 55 interposed between the upper side and the lower side, destined to be crossed by the one or more infeed threads of the knitting machine.

The plurality of seatings 51 of the separating element is defined in the passage opening 50.

The passage opening 55 is further destined to be crossed, from the lower side 53 to the upper side 52, by the one or more threads by effect of the aspiration, so that the one or more threads are positioned in the plurality of seatings, preferably each single seating containing a single infeed thread, such that each thread, during the aspiration, moves limitedly inside the respective seating, staying internal thereof and not entering into contact, at least at the passage opening 55, with the further threads crossing the separating element.

In an embodiment (not illustrated), the seatings are completely distinct from one another and each delimit a respective independent through-hole between the lower side and the upper side, in this case the separating element assuming a conformation with a separating wall provided with a plurality of holes.

As shown in the figures (in particular FIGS. 7, 8 and 9), the separating element 50 preferably comprises a plurality of protuberances 56 (i.e. projections, reliefs or protrusions) emerging singly from the wall 54 and developing in the passage opening 55, such that between each pair of adjacent protuberances 56 a single seating 51 is defined.

Each seating 51, defined between a pair of adjacent protuberances, is preferably partially open in, and communicating with, the passage opening 55 of the separating element.

The passage opening 55 is preferably single for the whole separating element 50 and is shaped such as to define the above-mentioned protuberances 56 and to realise the plurality of distinct seatings 51, the distinct seatings constituting in this case portions of the passage opening 55.

The protuberances 56 preferably emerge, developing in the passage opening 55, at distinct positions of the wall 54 of the separating element, the positions being angularly distributed along a circular portion of the wall or along the whole circular extension of the wall. In this way the seatings of the plurality of seatings are distributed circularly in the passage opening.

The external wall 54 is preferably continuous, still more preferably is closed to form a complete ring or is angularly interrupted to form a portion of ring.

The wall 54 of the separating element 50 is preferably in contact with the internal surface 40 of the thread aspirating device, so at to entirely intercept the above-mentioned section of the aspirating space 20.

As can be observed in the figures of the drawings, the plurality of protuberances 56 assumes overall a "comb" or "rake" conformation emerging from the wall 54 of the separating element 50 and open in the passage opening 55. The protuberances 56 preferably develop, emerging from the wall, in series along a substantially circular or arc of circumference section.

Each protuberance 56 preferably extends internally of the passage opening 55 over a respective extension, preferably variable and selectable for each protuberance. As shown in particular in FIG. 8, the protuberances located in a central position along the section preferably exhibit a greater extension than the protuberances located at an initial or final portion of the section.

As is visible in FIGS. 6, 7 and 9, the protuberances 56 preferably exhibit a tapering proceeding from the upper side 52 to the lower side 53 of the separating element, i.e. they exhibit a section which diminishes from the upper side to the lower side; in other words, they exhibit a dimension in the passage opening 55 that is larger at the upper side and smaller at the lower side.

The protuberances 56, at the lower side thereof, preferably exhibit a dimension in the passage opening that is substantially zero.

In substance, the protuberances are "beveled" at the lower side, where the insertion of the threads into the seatings commences: this facilitates the insertion of the threads and further prevents that, on expulsion of the cut thread portion, the portion might catch at the lower side before being expelled from the aspirating opening 14. The separating element 50 (if realized as a distinct body from the thread aspirating device and inserted into it) is fixed, preferably removably, internally of the thread aspirating device by fixing means 60 comprising form-coupling organs, for example a cotter or a pin, and/or one or more screws and/or one or more hooks and/or a weld joint and/or glue or the like.

An embodiment will now be described which includes a combination of the mouthpiece and the thread aspirating device (mounted so as to form a single thread aspirating device) with the thread separating element. In this case, illustrated in the figures and in particular in FIGS. 5 and 6, the thread aspirating device comprises:

- a body 2 of the thread aspirating device having a lower side 3, coinciding with the base 3, and defining the above-mentioned inlet opening 4;
- a mouthpiece 10, having a substantially tubular conformation, positioned above the body of the thread aspirating device and solidly constrained thereto, the mouthpiece being superiorly provided with the aspirating opening 14,
- wherein the mouthpiece and the body of the thread aspirating device overall form, in a reciprocally mounted condition, a thread aspirating device in a single body and overall internally define the thread aspirating space 20. In this embodiment, the separating element is positioned internally of the mouthpiece.

In this case the fixing means 60 comprise a groove, recessed in an internal surface of the mouthpiece, and a relief emerging externally from the wall of the separating element, the relief being configured so as to insert removably into the groove, so that the separating element is mounted to the mouthpiece according to a determined angular orientation with respect to the mouthpiece. Alternatively (as shown in the figures), the groove can be realized on the external wall of the separating element and the relief on the internal wall of the mouthpiece.

In a further embodiment (not illustrated), the thread separating element can be made in a single piece with the mouthpiece, the plurality of protuberances emerging from an internal wall of the mouthpiece and developing in the aspirating space. Alternatively, the thread separating element can be made in a single piece with the body of the thread aspirating device, with the plurality of protuberances emerging from a respective internal wall of the body of the thread aspirating device and developing in the aspirating space.

The functioning of the thread separating element includes each of the threads, once aspirated internally of the thread aspirating device, is positioned internally of a respective seating 51 (typically any one of the seatings) and remains internally of the seating (performing small-entity movements and without exiting the seating) until a cut of the free portion of the thread is made and the free portion is expelled from the upper aspirating opening.

The invention as it is conceived is susceptible to numerous modifications and variants, all falling within the scope of the inventive concept, and the cited components can be replaced by other technically-equivalent elements.

The invention offers important advantages. Primarily the invention enables obviating at least some of the drawbacks of the prior art. Further, the present invention enables having a thread aspirating device that is easily adaptable to different needs, in particular adaptable to knitting machines having different diameters of the needle cylinder. The possibility of having a mouthpiece and a body of the aspirating device provided with engaging and mounting portions that can always be combined, where the body of the aspirating device has a measure correlated to the diameter of the machine to which it is destined, while the mouthpiece is one only and interchangeable regardless of the measure of the aspirating device advantageously enables the use of modular components and reduces the costs connected with the realization of the various thread aspirating devices destined for the various knitting machines.

The realisation of a plurality of mouthpieces, destined for knitting machines having different characteristics (especially dimensional), requires one die only, as the mouthpiece is "universal" and adaptable to various thread aspirating device. The partition between the mouthpiece and the body of the aspirating device, having specific dimensional requisites, further facilitates the maintenance operations, as each part can be replaced independently.

In turn the separating element enables important advantages to be attained.

Primarily a thread aspirating device provided with the element enables obviating the typical thread knotting problems due to air swirls present internally of the aspirating space. Further, the thread aspirating device provided with the separating element enables eliminating or reducing machine downtimes due to thread knotting internally of the thread aspirating device.

Also, the separating element enables maintaining the aspirated threads in the aspirating device separate, improving the quality of the fabric produced and the knitting performance of the machine. Further, the thread aspirating device of the present invention is characterised by a competitive cost and a rational and modular structure.

The invention claimed is:

1. A thread aspirating device (1) for circular knitting machines, comprising:

a body (2) of the thread aspirating device having a lower side (3), configured to be mounted to a support plate of a dial group of a circular knitting machine and defining, when in a mounted condition to the support plate, at least an inlet opening (4) configured to allow the entry of one or more threads in the thread aspirating device, and an upper side (5), provided with an engaging portion (6) delimiting a passage opening (7) in the upper side;

a mouthpiece (10), distinct from the body (2) of the thread aspirating device, having a substantially tubular conformation and extending between an open lower end (11), defining a mounting portion (12) complementarily shaped to the engaging portion (6) of the body of the thread aspirating device, and an upper end (13) provided with an aspirating opening (14) configured to be connected to an air aspirating device for generating a negative pressure internally of the thread aspirating device and realize an aspiration of one or more threads into the thread aspirating device via the inlet opening (4);

wherein the mouthpiece (10) is superiorly mounted on the body (2) of the thread aspirating device in such a way that the mounting portion (12) of the mouthpiece corresponds to the engaging portion (6) of the body (2) of the thread aspirating device and the mouthpiece (10) and the body (2) of the thread aspirating device internally define an aspirating space (20) of the threads extending between the inlet opening (4) and the aspirating opening (14), wherein the mouthpiece (10) and the body (2) of the thread aspirating device overall form, in mutual mounting condition, a thread aspirating device (1) in a single body configured for aspirating internally thereof, and maintaining in the aspirating space (20), one or more threads in infeed to the knitting machine, wherein the inlet opening (4) is defined along a lateral edge (8) of the body (2) of the device (1), and wherein the lateral edge (8) of the body of the thread aspirating device has an arched conformation characterised by a determined radius of curvature and a determined lateral extension, which define a device measure, the device measure being directly correlated to the diameter of the needle cylinder of the knitting machine to which the thread aspirating device is configured to be mounted.

2. The thread aspirating device (1) of claim 1, wherein the thread aspirating device is configured to be positioned in a dial group of a knitting machine and is configured so as to suck in one or more threads and respective fluff, or wherein the lateral edge (8) is configured to be positioned, with the device in the mounted configuration to the support plate of a dial group, at a portion of a perimeter edge of the support plate and superiorly thereof, in such a way as to be superiorly aligned with a thread transport and cutting element, rotatably mounted externally of the support plate.

3. The thread aspirating device (1) of claim 2, wherein the determined radius of curvature of the lateral edge (8) of the body (2) of the thread aspirating device is substantially equal, or proportional, to half the diameter of the needle cylinder of the knitting machine to which the thread aspirating device (1) is configured to be mounted.

4. The thread aspirating device (1) of claim 1, wherein the mouthpiece (10) is structurally dimensioned and conformed in a single way, in particular as regards the shape and dimensions of the mounting portion (12), regardless of the diameter of the needle cylinder of the knitting machine to which the thread aspirating device is configured to be mounted, while the body (2) of the thread aspirating device, to which the mouthpiece is to be mounted, is selected from a plurality of possible thread aspirating bodies, which have in common a shape and dimensions of the engaging portion (6), complementarily shaped to the mounting portion (12), and differ as far as the respective thread aspirating device measure is concerned, the device measure being selectable without modifying the structure or dimensions of the mouthpiece (10).

5. The thread aspirating device (1) of claim 1, wherein the body (2) of the device (1) and the mouthpiece (10) are made of different materials.

6. The thread aspirating device (1) of claim 1, comprising at least a seal element (18) interposed between and in contact with the mounting portion (12) of the mouthpiece (10) and the engaging portion (6) of the body (2) of the thread aspirating device, the seal element (18) being configured so as to guarantee an air seal between the mouthpiece and the body of the thread aspirating device (1), when the thread aspirating device is mounted.

7. A set of thread aspirating devices (1) for circular knitting machines, the set comprising:

a plurality of bodies (2) of the thread aspirating device each configured to realize a respective thread aspirating device, each body of the device having a lower side (3), configured to be mounted to a support plate of a dial group of a circular knitting machine and defining, in a mounted configuration to the support plate, an inlet opening (4) configured for enabling inlet of one or more threads into the thread aspirating device, and an upper side (5) provided with an engaging portion (6) delimiting a passage opening (7) in the upper side, and wherein each body (2) of the thread aspirating device has the respective inlet opening (4) thereof defined along a respective lateral edge (8) of the body of the thread aspirating device, the lateral edge (8) being configured to be positioned, with the thread aspirating device in the mounted configuration to the support plate of a dial group, at a portion of a perimeter edge of the support plate and superiorly thereof, so as to be superiorly aligned with a thread transport and cutting element, rotatably mounted externally of the support plate, and wherein the lateral edge (8) of the body of the thread aspirating device has an arched conformation characterised by a determined radius of curvature and by a determined lateral extension, which define a device measure, the device measure being directly correlated to the diameter of the needle cylinder of the knitting machine to which the thread aspirating device is configured to be mounted;

a plurality of mouthpieces (10) each configured to realise a respective thread aspirating device, each mouthpiece (10) having a substantially tubular conformation and extending between an open lower end (11), defining a mounting portion (12), complementarily shaped to the engaging portion (6) of the bodies of the thread aspirating device, and an upper end (13) provided with an aspirating opening (14) configured to be connected to an air aspirating source so as to generate a negative pressure internally of the thread aspirating device and to realize an aspiration of one or more threads into the thread aspirating device by means of the inlet opening (4);

wherein the dimension and conformation of the engaging portion (6) of all the thread aspirating devices (2) of the plurality of bodies of the device is single and corresponds to the dimension of the mounting portion (12) of all the mouthpieces (10) of the plurality of mouthpieces (10), and wherein each mouthpiece (10) is configured so as to be mountable superiorly to any body (2) of the thread aspirating devices belonging to the plurality of bodies of the device, such that the respective mounting portion (12) of the mouthpiece corresponds to the respective engaging portion (6) of the body of the thread aspirating device and the mouthpiece (10) and the body (2) of the thread aspirating device internally define an aspirating space (20) of the threads extending between the inlet opening (4) and the aspirating opening (14), and wherein each mouthpiece (10) and the respective body (2) of the thread aspirating device overall form, in a mutual mounting condition, a thread aspirating device (1) in a single body.

8. A set of thread aspirating devices (1) as in claim 7, wherein all the mouthpieces (10) of the plurality of mouthpieces are structurally dimensioned and conformed singly, while the respective measure of each body (2) of the thread aspirating device of the plurality of bodies of the thread aspirating device is selected from among a plurality of possible measures, each correlated to a diameter value of the needle cylinder of the knitting machine on which the body of the device is configured to be mounted, and wherein the set comprises:

at least a first group of thread aspirating devices (1) made up of a first number of thread aspirating devices each comprising any mouthpiece (10) of the plurality of mouthpieces and a body (2) of the thread aspirating device having a first value of the measure and being selected from among the plurality of bodies of the mouthpiece, the first group of thread aspirating devices (1) being configured so as to be mounted in a circular knitting machine having a needle cylinder characterised by a respective first diameter value;

at least a second group of thread aspirating devices (1), distinct from the first group, made up of a second number of thread aspirating devices, each comprising any mouthpiece (10) of the plurality of mouthpieces and a body (2) of the thread aspirating device having a second value of the measure and being selected from the plurality of bodies of the thread aspirating device, the second group of thread aspirating devices being configured so as to be mounted in a circular knitting machine having a needle cylinder characterised by a respective second diameter value; the first and second value of the measure being selected from among the plurality of possible measures of the body of the thread aspirating device.

9. A method for realising thread aspirating devices (1) for circular knitting machines, comprising steps of:

realising at least a body (2) of the mouthpiece having a lower side (3), configured to be mounted to a support plate of a dial group of a circular knitting machine and defining, in a mounted configuration to the support plate, an inlet opening (4) configured so as to enable inlet of one or more threads into the thread aspirating device, and an upper side (5) provided with an engaging portion (6) delimiting a passage opening (7) in the upper side, and wherein the body (2) of the aspirating device has the respective inlet opening defined along a lateral edge (8) of the body of the aspirating device, the lateral edge (8) being configured to be positioned, with the mouthpiece in the mounted configuration to the support plate of a dial group, at a portion of a perimeter edge of the support plate and superiorly thereof, such as to be superiorly aligned with a thread transport and cutting element, rotatably mounted externally of the support plate, and wherein the lateral edge (8) of the body (2) of the thread aspirating device has an arched conformation characterised by a determined radius of curvature and a determined lateral extension, which define a device measure, the device measure being directly correlated to the diameter of the needle cylinder of the knitting machine to which the thread aspirating device is configured to be mounted;

realising at least a mouthpiece (10) having a substantially tubular conformation and extending between an open lower end (11), defining a mounting portion (12) complementarily shaped to the engaging portion (6) of the body of the thread aspirating device, and an upper end (13) provided with an aspirating opening (14) configured to be connected to an aspirating device for generating a negative pressure internally of the thread aspirating device and to realize an aspiration of one or more threads into the thread aspirating device through the inlet opening (4);

mounting the mouthpiece (10) superiorly of the body (2) of the thread aspirating device in such a way that the mounting portion (12) of the mouthpiece corresponds to the engaging portion (6) of the body of the thread aspirating device and the mouthpiece and the body of the aspirating device internally define an aspirating space (20) of the threads extending between the inlet opening (4) and the aspirating opening (14), the mouthpiece and the body of the aspirating device forming overall, in a condition of mutual mounting, a thread aspirating device (1) in a single body;

wherein, during the steps of realising at least a body (2) of the aspirating device and realising at least a mouthpiece (10), the dimension and conformation of the engaging portion (6) of the at least a thread aspirating device is single and corresponds to the dimension of the mounting portion (12) of the at least a mouthpiece (10), wherein the mouthpiece (10) is structurally dimensioned and conformed singly regardless of the diameter of the needle cylinder of the knitting machine to which the thread aspirating device is configured to be mounted, and wherein the step of realizing at least a body (2) of the thread aspirating device comprises a step of selecting the measure of the at least a thread aspirating group from among a plurality of possible measures, each correlated to a diameter value of the needle cylinder of the knitting machine on which the body of the thread aspirating device is configured to be mounted.

10. The method of claim 9, comprising steps of:

realising a plurality of the bodies (2) of the thread aspirating device, each configured to realise a respective thread aspirating device (1);

realising a plurality of the mouthpieces (10), each configured to realise a respective thread aspirating device (1);

realising, by means of a plurality of mounting steps, at least a first group of thread aspirating devices made up of a first number of thread aspirating devices each comprising any mouthpiece (10) of the plurality of mouthpieces and a body (2) of the thread aspirating device having a first value of the measure and selected from among the plurality of bodies of the thread aspirating device, the first group of mouthpieces being configured so as to be mounted in a circular knitting machine having a needle cylinder characterised by a respective first diameter value;

realising, by means of the plurality of the mounting steps, at least a second group of thread aspirating devices, distinct from the first group, made up by a second number of thread aspirating devices, each comprising any mouthpiece (10) of the plurality of mouthpieces and a body (2) of the thread aspirating device having a second value of the measure and selected from the plurality of bodies of the thread aspirating device, the second group of thread aspirating devices being configured so as to be mounted in a circular knitting machine having a needle cylinder characterised by a respective second diameter value;

wherein the first and second value of the measure are selected from among the plurality of possible measures of the body of the thread aspirating device.

11. The thread aspirating device (1) of claim 2, wherein the determined lateral extension of the lateral edge (8) of the body of the thread aspirating device is substantially equal to the distance between two adjacent thread feeders, or thread feeding points, of the knitting machine.

12. The thread aspirating device (1) of claim 2, wherein the device measure increases with an increase of the diameter of the needle cylinder of the knitting machine on which the body of the aspirating device is configured to be mounted, in particular they increase the radius of curvature and the lateral extension of the lateral edge.

13. The thread aspirating device (1) of claim 1, wherein the body of the thread aspirating device is entirely made of a single material, and the mouthpiece is entirely made of a single respective material.

14. The thread aspirating device (1) of claim 1, wherein the body (2) of the mouthpiece is made of iron, zinc, aluminium, cast iron, steel, or alloys of the preceding.

15. The thread aspirating device (1) of claim 1, wherein the mouthpiece (10) is made of a polymer material or a plastic material comprising a percentage of carbon being at least 10% in weight or 20% in weight or 30% in weight.

16. The thread aspirating device (1) of claim 6, wherein the seal element (18) is a gasket.

17. The thread aspirating device (1) of claim 1, wherein the thread aspirating device (1) comprises assembling means configured so as to mount the mouthpiece (10) to the body (2) of the thread aspirating device, in such a way that the mounting portion (12) is coupled to the engaging portion (6).

18. The thread aspirating device (1) of claim 17, wherein the assembling means (30) comprising one or more screws (31) or one or more hooks or a weld seam or a glue.

* * * * *